US006340048B1

(12) United States Patent
Tsune et al.

(10) Patent No.: US 6,340,048 B1
(45) Date of Patent: Jan. 22, 2002

(54) MOLD FOR USE IN CONTINUOUS METAL CASTING

(75) Inventors: Kiyoshi Tsune, Kobe; Fumiki Asano, Osaka, both of (JP)

(73) Assignee: Kabushiki Kaisha Kobe Seiko Sho., Kobe (JP)

( * ) Notice: Subject to any disclaimer, the term of this patent is extended or adjusted under 35 U.S.C. 154(b) by 0 days.

(21) Appl. No.: 09/361,125

(22) Filed: Jul. 27, 1999

(30) Foreign Application Priority Data

Jul. 31, 1998 (JP) ..... 10-217576

(51) Int. Cl.[7] ..... B22D 11/00
(52) U.S. Cl. ..... 164/418; 164/459
(58) Field of Search ..... 164/418, 459

(56) References Cited

U.S. PATENT DOCUMENTS 4,249,590 A * 2/1981 William ..... 164/418
5,360,053 A * 11/1994 Kawa et al. ..... 164/418

FOREIGN PATENT DOCUMENTS

| | | | |
|---|---|---|---|
| CH | 617608 | | 12/1978 |
| DE | 4435218 | A1 | 9/1994 |
| DE | 4435218 | * | 4/1996 |
| JP | 56-53849 | | 5/1981 |
| JP | 57-79047 | | 5/1982 |
| JP | 2-207945 | * | 8/1990 |
| JP | 07-67600 | | 7/1995 |
| JP | 09-314287 | | 12/1997 |

* cited by examiner

*Primary Examiner*—Nam Nguyen
*Assistant Examiner*—I.-H. Lin
(74) *Attorney, Agent, or Firm*—Reed Smith Hazel & Thomas LLP

(57) ABSTRACT

A mold suitable for continuous metal casting comprising a cavity opened at both ends, in which a vertical cross sectional shape at the inner wall surface of the cavity from a meniscus position to a required region is formed as a restriction portion corresponding to the amount of shrinkage of a charged material from a liquid phase to a solid phase. This can prevent internal cracks at the corners of a cast product formed in the chilled layer. Then, a mold for use in continuous metal casting capable of coping with increasing casting rate is provided.

17 Claims, 5 Drawing Sheets

PRIOR ART

PRIOR ART

MOLD FOR USE IN CONTINUOUS METAL CASTING

BACKGROUND OF THE INVENTION

1. Field of the Invention

The present invention concerns a mold for use in continuous metal casting having a cavity opened at both ends.

2. Description of the Related Art

A continuous casting process is adapted to produce cast products such as billets, blooms or slabs continuously from molten metals and has advantages of high yield and capable of producing products with reduced number of steps.

The continuous casting process, however, has a problem in that air gaps are formed between a solidified shell of a cast product and a mold wall. The air gaps remarkably lower heat transmission between the mold and the solidified shell, give not uniform cooling for the solidified shell, form internal cracks at the corners of the cast product, which result in break-out of the cast products in an extremely case. The internal cracks at the corners of the cast product are caused by delayed cooling at the corners of the cast product, and it is considered that the cracks are formed by bending stresses (tensile components) exerted on the corners of the cast products due to uneven thickness of the solidified shell caused by difference of cooling conditions between the sides and the corners of the mold during proceeding of cooling under intermittent contact in the course of continuous withdrawal also after the formation of the air gaps in the mold.

In order to prevent occurrence of the air gaps, optimization of a taper for a cast cavity (space in the mold for forming the cast product), injection of a coolant into the air gaps and the like have been proposed for attaining effective contact between the solidified shell of the cast product and the mold wall.

For example, as a method of optimizing the taper for the mold cavity, a mold for use in continuous casting considering a hot extraction characteristic value of mold flux in the mold also used as a lubricant has been proposed (refer to Japanese Published Unexamined Patent Application No. 56-53849, which is hereby fully incorporated by reference). As shown in FIG. 4*a* and FIG. 4*b*, a taper at a shorter side 12 of a mold is determined so as to satisfy a specific condition (relation) in order to improve the cooling state at the corners of a cast product as a slab mold. The mold wall surface has a convex protruding toward a slab along the casting direction, and the taper is increased within a range from 5 cm to 10 cm in the vicinity of a meniscus position, while decreased toward the bottom (exit) so as not to increase friction between the cast product and the mold wall in the lower portion of the mold.

The patent literature describes that this constitution can eliminate the air gap caused on the shorter side of a slab mold and, further, prevent break-out of a cast product by suppression of friction between the cast product and the mold wall which increases along with increase of a casting speed, as well as can prevent break-out of the mold by drastically reducing longitudinal cracks on the surface and the inside of the corners of the cast product formed frequently so far in specific kinds of steels (high carbon steel, low alloy special steel, and the like).

Further, a mold for use in continuous casting has also been proposed, as shown in FIG. 5*a*, in which an additional extension 15 is disposed to a portion at an upper-half 13 of a continuous casting mold to form an enlarged transverse cross sectional portion 16 (refer to FIG. 5*b*), and the circumferential length of the mold is partially increased by the provision of the enlarged transverse cross sectional portion 16, thereby aligning the circumferential length of the mold with the circumferential length of the cast product upon solid shrinkage, and suppressing formation of air gaps at the corners of the mold (refer to Japanese Published Examined Patent Application No. 7-67600, which is hereby incorporated by reference).

The patent publication describes that the constitution can prevent surface defects at the corners and greatly reduce destruction or break-out of cast products tending to occur in high speed casting.

In addition, it has also been proposed a continuous casting mold for a cast product of a circular cross section having a taper of 5.0~19.0%/m in a meniscus portion considering solid shrinkage accompanied by $\delta \rightarrow \gamma$ transformation of a solidified shell just after solidification in hypoperitectic steels (0.08~0.15 mass % C) (Japanese Published Unexamined Patent Application No. 9-314287, which is hereby incorporated by reference).

Since the hypoperitectic steels have low carbon content, the structure at the initial stage of solidification shows a $\delta$ phase like that pure iron, which transforms to a $\gamma$ phase along with proceeding of cooling. As shown by A in FIG. 2, phase transformation from the $\delta$ phase to the y phase at the initial stage of solidification results a relatively large change in the specific volume and, accordingly, a taper corresponding to the solid shrinkage accompanied by the phase transformation is provided to the meniscus portion of the mold.

The patent literature describes that the disclosed continuous casting mold can prevent formation of air gaps formed by large solid shrinkage accompanied by transformation of a solidified shell from the $\delta$ phase to the $\gamma$ phase, and formation of cracks in the cast product due to solidification delay in the solidified shell at the portion of the air gaps.

However, even by the above-mentioned method of optimizing the taper for the mold cavity, formation of the air gap at the corners of the mold wall can not be completely prevented or suppressed. This is because any of the methods described above is based on the shrinkage of the solidified shell cooled and formed in the solid state (solid phase), and the taper formed thereby for the mold cavity can not be said appropriate but forms air gaps between the mold and the cast product and, further, forms air gaps at the corners of the mold to make a delay in the cooling speed, which brings about internal vertical cracks at the corners of the cast product. That is, it is difficult to eliminate the air gaps at the corners of the mold wall conforming to the solid shrinkage of the solidified shell of the cast product including the corners of the mold wall.

In the existent mold for use in continuous casting described above, internal cracks at the corners of the cast product, particularly, internal cracks at the corners of the cast product formed in a thin chilled layer present 2 to 3 mm below the surface layer can not sometimes be prevented.

The internal cracks at the corners of the cast product are caused by cooling delay for corners of the cast product due to the air gaps inevitably formed at the corners of the mold wall described above, and the internal cracks become remarkable along with increase of the casting rate, leading to a problem that the productivity of continuous casting by increasing the casting rate can not be improved.

Furthermore, the internal cracks at the corners of the cast product increases degree of fabrication to the cast product, reduces the yield and, in an extreme case, causes break-out of the cast product, to interrupt continuous casting operation and, as a result, remarkably lowering the productivity in the continuous casting.

SUMMARY OF THE INVENTION

An object of the present invention is to provide a mold for use in continuous metal casting capable of preventing internal cracks formed in a chilled layer at the corners of a cast product and capable of coping with increasing casting rate.

The present invention has been accomplished on the basis of a novel finding that internal cracks formed in a chilled layer at the corners of a cast product are caused by formation of air gaps due to shrinkage accompanied by the phase change of molten metal supplied to the mold from a liquid phase to a solid phase in continuous casting to form a solidified shell from the molten state at the meniscus portion.

According to the present invention, in order to prevent formation of air gaps caused by the shrinkage, a restriction portion corresponding to the amount of shrinkage along with formation of a solidified shell from a molten metal near the meniscus is additionally disposed to an inner wall surface of a continuous casting mold, thereby maintaining the solidified shell of the cast product in an effective contact state from the initial stage of formation to withdrawal from the mold.

DESCRIPTION OF THE PREFERRED EMBODIMENTS

In a continuous casting mold according to a preferred embodiment of the present invention, a restriction portion is disposed to an inner wall surface of a continuous casting mold corresponding to the amount of shrinkage along with formation of a solidified shell from a molten metal near a meniscus. In the process for determining the profile of a cavity in a mold according to the present invention, a predominant shrinking phenomenon of a molten metal in the mold is to be explained more specifically with reference to FIG. 2 and FIG. 3.

Figure 2:
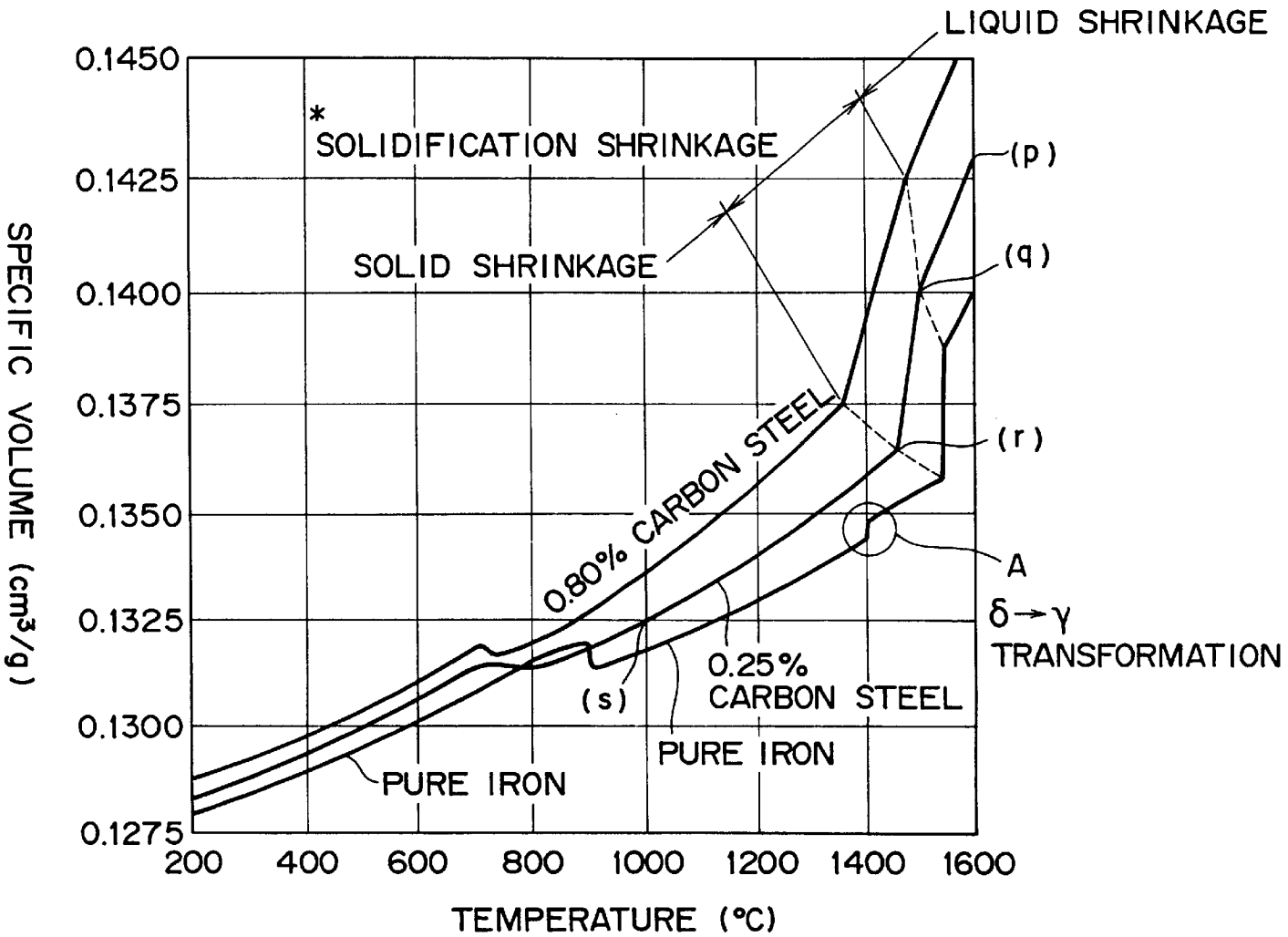
FIG. 2 is a graph showing change of a specific volume in pure iron and carbon steel along with progress of temperature and mark * of the graph indicates shrinkage caused by phase change from the liquid phase state to the solid phase.
Figure 3:
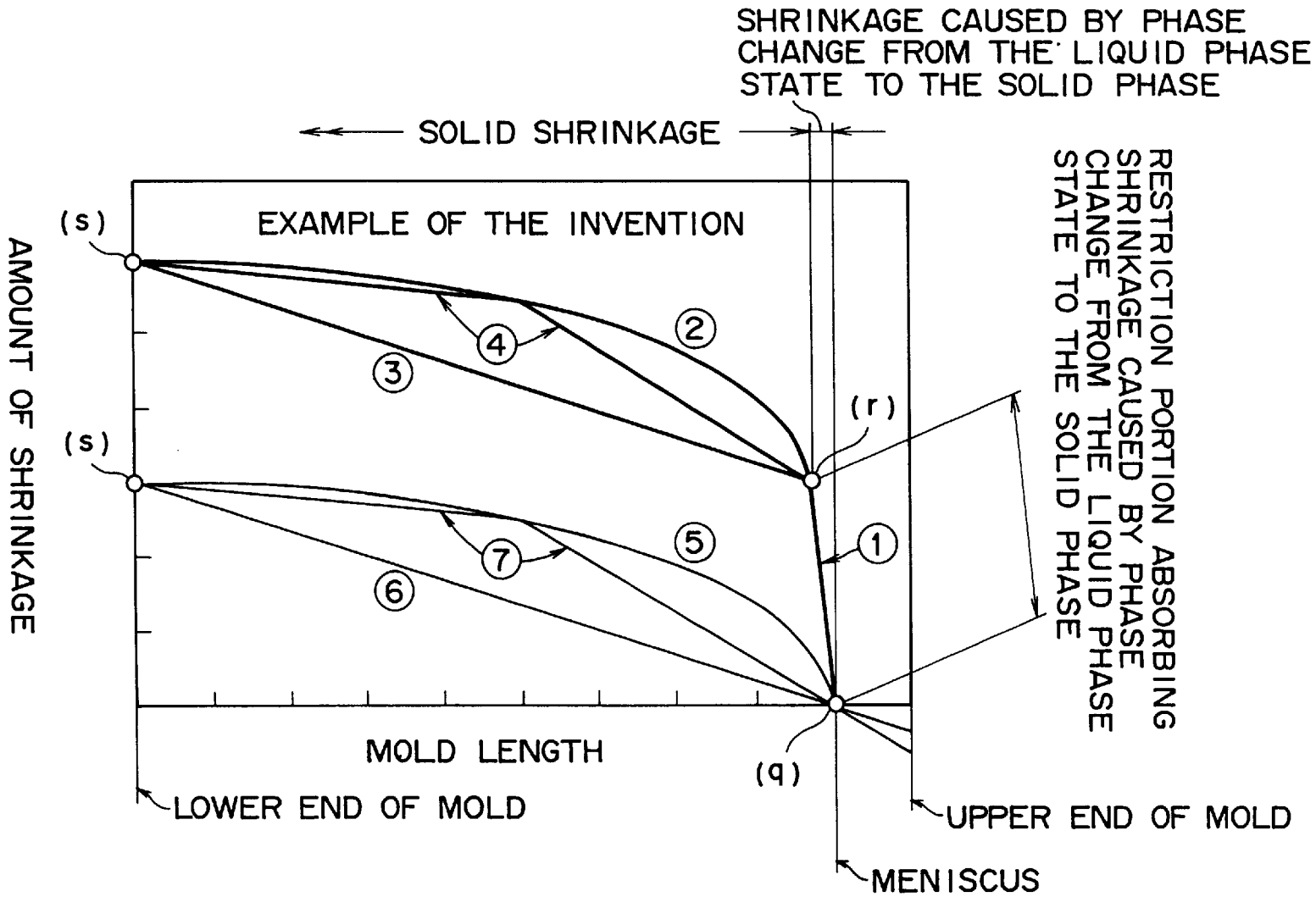
FIG. 3 is an explanatory view showing an example for the change on the mount of shrinkage of a cast product in a mold after starting solidification as example, by showing a positional relationship relative to an amount of shrinkage corrected by a linear expansion coefficient for the change of a specific volume of 0.25 mass% carbon steel indicated on an ordinate.
Figure 4A:
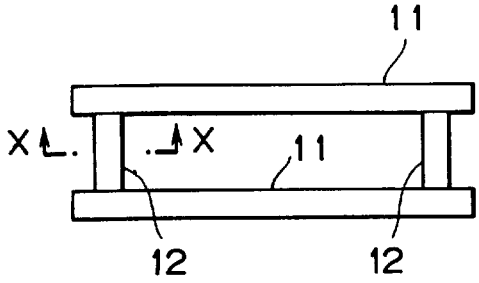
FIG. 4*a* is a schematic plan view for an existent continuous casting mold and FIG. 4*b* is a vertical cross sectional view of a shorter side along X—X in FIG. 4*a*.
Figure 4B:
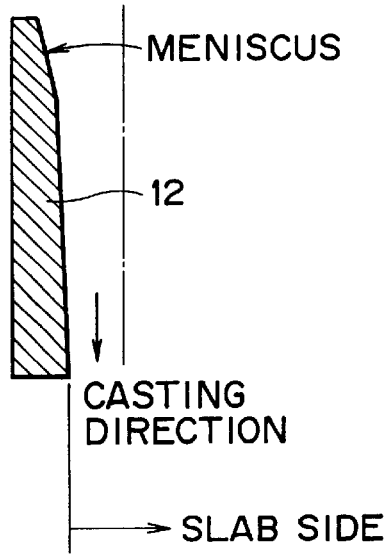
PRIOR ART FIG. 4b
Figure 5A:
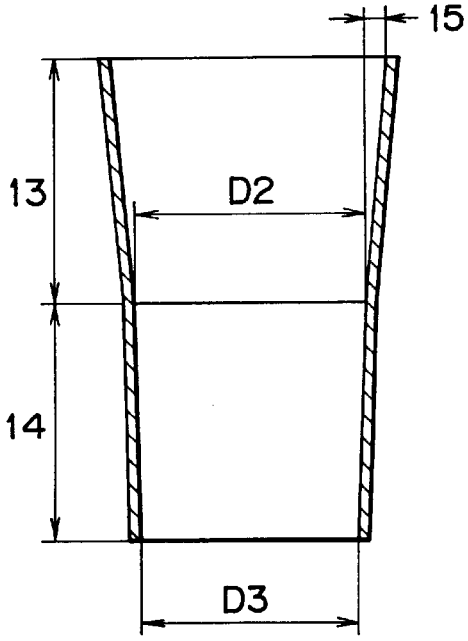
PRIOR ART FIG. 5a
FIG. 5*a* is a vertical cross sectional view of one side of another existent continuous casting mold along X—X in FIG. 5*b*.
Figure 5B:
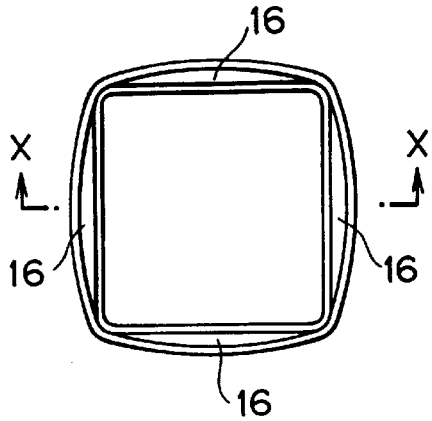
PRIOR ART FIG. 5b
FIG. 5*b* is a plain view of the mold.

FIG. 2 is a graph showing the change of specific volume in pure iron and carbon steel along with progress of temperature, and FIG. 3 is an explanatory view showing an example for the change of the mount of shrinkage of a cast product in a mold after starting solidification as example by showing a positional relationship relative to an amount of shrinkage corrected by a linear expansion coefficient for the change of a specific volume of 0.25 mass % carbon steel indicated on an ordinate.

FIG. 2 shows variation coefficients of specific volume for pure iron, 0.25 mass % C and 0.80 mass % C carbon steels. For any kind of steels, three types of shrinkage are formed time sequentially, namely, liquid shrinkage in the liquid phase state (p→q) caused along lowering of temperature of molten steel from the molten state (p) to the solidification start point (q); shrinkage caused by phase change from the liquid phase state to the solid phase (q→r) along temperature lowering (cooling) in a solid/liquid coexistent region from solidification start point (q) to the solidification end point (r); and solid shrinkage (r→s) caused by lowering of temperature from the solidification end point to the withdrawal of the cast product from the mold and controlled under linear expansion coefficient. The amount of shrinkage for each of liquid shrinkage, shrinkage caused by phase change from the liquid phase state to the solid phase and solid shrinkage can be recognized as a physical amount determined by the chemical composition of the cast product respectively.

As can be seen from FIG. 2, among the change of the specific volume in the course of cooling, the solid shrinkage (r→s) has a large ratio, whereas phase transformation from the solidification starting point (q) to the solidification end point (r), namely, the shrinkage caused by phase change from the liquid phase state to the solid phase (q→r) occurs abruptly in a narrow temperature range, in view of the variation coefficient for the change of the specific volume.

For the phenomenon in the mold during continuous casting, it is important to examine the shrinkage caused by phase change from the liquid phase state to the solid phase, that is, the solidification process in the mold.

Then, referring to the solidification process in the mold in a case of continuous casting for 0.25% C carbon steel as an example, when molten steel heated to a liquidus line temperature +20° C. is cast into a mold, the molten steel in contact at a meniscus portion with a mold wall undergoes cooling and instantaneously reaches a liquidus line temperature (about 1500° C.), starts phase change from the liquid phase to the solid phase, namely, starts solidification (point q in FIG. 2), and completes solidification at a solidus temperature of about 1475° C. (point r, in FIG. 2). Successively, the cast product proceeds solid shrinkage while being cooled in contact with the mold (points r→s in FIG. 2) and then finally withdrawn from the mold at the surface temperature of the cast product of about 1000° C.

This can be arranged in view of the amount of shrinkage of a cast product as shown in FIG. 3. That is, molten steel cast into a mold is in contact at a meniscus portion with a mold wall and, at the same time, starts solidification, shrinks along with progress of solidification as shown by a line ① in the figure and completes solidification at a point (r). The process from the start to the end of the solidification is completed near the meniscus in an extremely short period of time in which a chilled layer as a solidified shell is formed.

Further, solidification proceeds continuously accompanying solid shrinkage by the cooling effect of the mold as shown by a curve ② continuously from the point (r).

The linear shrinkage ratio of the mold due to the solidification shrinkage shows a value as large as about 0.7%. As described above, the shrinkage accompanied by the phase change from the liquid phase to the solid phase is rapidly formed within the mold in a short period of time at the initial stage of continuous casting. This is, the shrinkage is a phenomenon occurring near the meniscus in which a solidified shell is formed when the molten metal charged into the mold starts solidification from the instance of contact with mold (within one sec after the contact). In addition, since the static pressure of the molten steel acting on the solidified shell is extremely low near the meniscus and no deformation stresses are caused, air gaps are not formed by the shrinkage due to the formation of the solidified shell accompanied by the phase change from the liquid phase to the solid phase.

Accordingly, in order to prevent formation of the air gaps by the shrinkage caused by phase change from the liquid phase state to the solid phase in the mold to maximize the heat dissipating effect of the mold for uniform cooling of the mold, it is important to early absorb the shrinkage accompanied by the phase change from the liquid phase to the solid phase and occurring near the meniscus, that is, to support the solidified shell immediately after the shrinkage caused by phase change from the liquid phase state to the solid phase by the mold just beneath the meniscus.

The method of optimizing the taper in the existent mold is to be explained with reference to a schematic chart shown in a lower portion of FIG. 3 for better understanding of the present invention.

In the existent mold, the taper is formed from the meniscus (including the vicinity of meniscus) to the lower end of the mold by one step line ⑥ or two step line ⑦ in accordance with the shrinkage of the cast product, a so-called solid shrinkage curve ⑤ and so as to be identical or approximate therewith. Taking notice on the meniscus portion, since there is a large difference in the amount of shrinkage formed to the solidified shell in this stage, it can be seen that the air gaps can not be absorbed even when any taper is provided so long as it is provided being based on the solid shrinkage.

Figure 1:
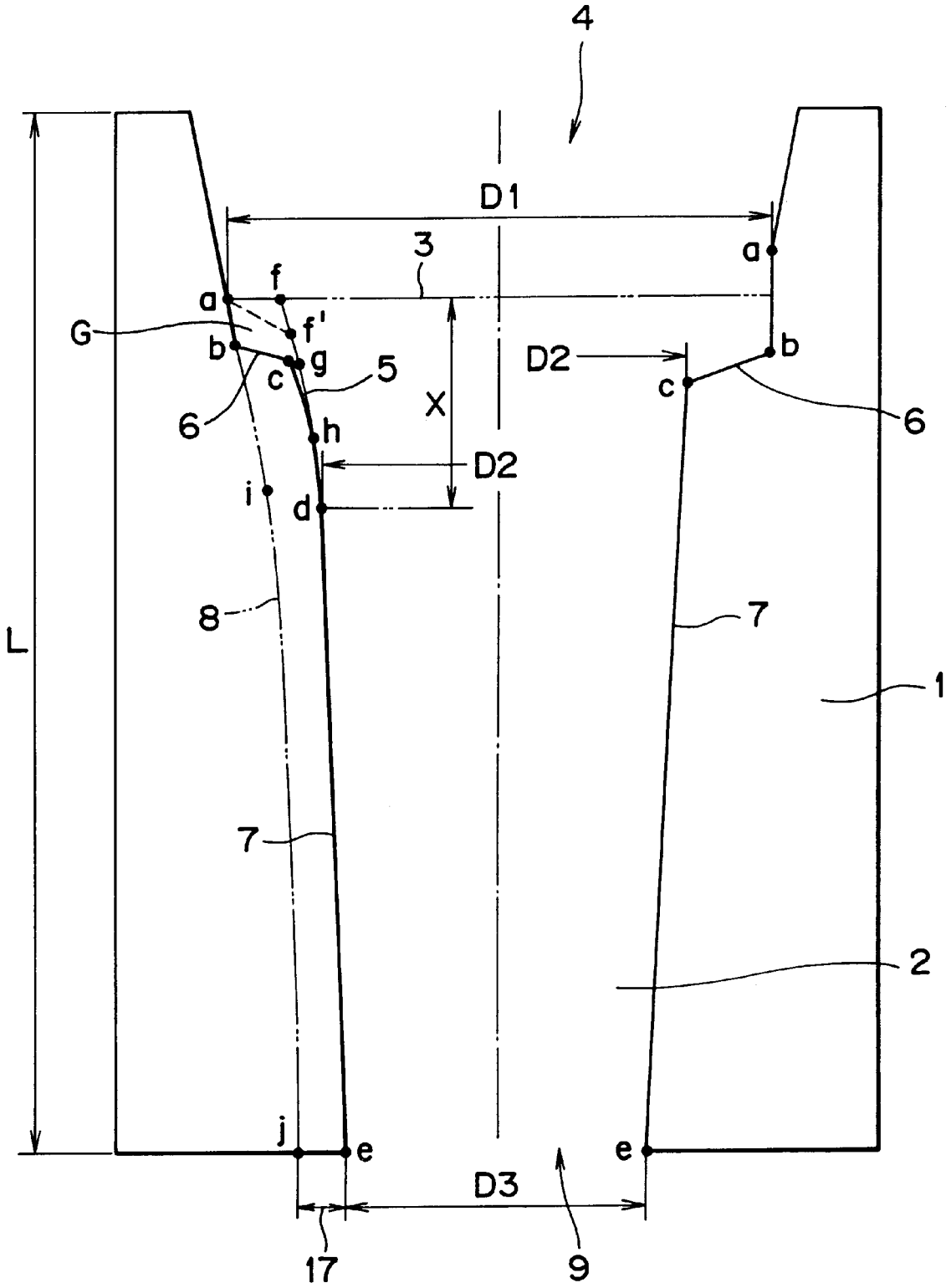
FIG. 1 is a view illustrating a profile for a continuous casting mold in an embodiment according to the present invention (air gap 17 shown in this figure is somewhat enlarged only for the sake of explanation)

Accordingly, in order to absorb an excess shrinkage caused by phase change from the liquid phase state to the solid phase caused in the mold within a narrow temperature range at the initial stage of continuous casting, that is, within an extremely short period of time near the meniscus in the mold to thereby ensure the contact of the cast product after shrinkage with the mold again, a restriction portion for absorbing an amount of shrinkage caused by phase change from the liquid phase state to the solid phase corresponding to the solid line ① in FIG. 1 is newly adopted, based on which the present invention has been completed.

That is, the present invention has been accomplished taking notice on the shrinkage caused by phase change from the liquid phase state to the solid phase caused by the formation of the solidified shell not considered in the existent continuous casting mold.

The present invention provides a mold for use in continuous metal casting having a cavity opened at both ends, in which a vertical cross sectional shape from a meniscus position to a required region in the cavity is formed as a restriction portion corresponding to the amount of shrinkage of a charged metal from the liquid phase to the solid phase.

Since the restriction portion for continuous casting mold in the present invention has an amount of linear shrinkage corresponding to about 0.7% in 0.25 mass % C carbon steel as described above and shows an abrupt step change in the meniscus portion as shown in FIG. 3, it is desirable that the portion has such a shape as aligned with a trace of the stepwise shrinkage caused by phase change from the liquid phase state to the solid phase.

In summary, the feature of the present invention resides, regarding the shrinkage formed by shrinkage caused by phase change from the liquid phase state to the solid phase and the air gaps attributable thereto, in absorbing air gaps in the meniscus portion immediately thereafter, maintaining the hold and contact state of the cast product and intending for uniform cooling to the cast product.

The restriction portion is disposed, preferably, at a position within 100 mm from the meniscus position.

This is because the solidified shell can be held and in contact with the mold wall surface effectively from the stage of starting formation of the solidified shell reliably by disposing the restriction portion to the inner wall surface of the cavity at a position within 100 mm from the meniscus, so that formation of the air gaps can be prevented.

The starting position for the restriction portion is determined considering the casting rate, the composition of molten metal, vibration strokes of the mold and the like and, as a basic condition, the restriction portion is disposed at a meniscus position.

Further, the starting position for the restriction portion can also be situated below the meniscus position by so much as a vibration amplitude of the mold. Then, the starting position for the restriction portion is always kept below the position of the molten surface in the mold making it easy to cope with the shrinkage caused by phase change from the liquid phase state to the solid phase of the molten metal.

On the other hand, the factor for determining the end position of the restriction portion mainly depends on the casting rate. As can be seen from the foregoing explanation, since the phenomenon of the shrinkage accompanied by the phase change occurs within a short period of time, it may suffice to dispose the end position up to 100 mm, preferably, 70 mm and, more preferably, 30 mm from the meniscus position, by which the solidified shell can be reliably kept and in contact with the wall surface of the mold upon completion of formation of the solidified shell, so that the subsequent cooling performance of the mold can be utilized most effectively.

In the present invention, when the size of the restriction portion at the starting position is defined as a cavity size at the meniscus position, it is preferred that the size of the restriction portion at the end position is made smaller by from 0.2% to 1.5% than the cavity size at the meniscus position.

By determining the size reduction ratio (%) for the restriction portion, namely ((cavity size at meniscus position)−(size of the restriction portion at end position))/(cavity size at meniscus position)×100 as from 0.2% to 1.5%, it can cope with the amount of shrinkage caused by phase change from the liquid phase state to the solid phase of the molten metal and the solidified shell can be reliably kept and in contact with the mold wall from the starting stage of forming the solidified shell.

The size reduction ratio (%) for the restriction portion is defined as within a range from 0.2% to 1.5%, because the ratio of shrinkage caused by phase change from the liquid phase state to the solid phase of the molten metal is a volumic change within a range from about 0.7 to 4.4% depending on the composition of metals, which is a range from about 0.2 to 1.5% when converted as a linear shrinkage ratio.

In this case, it is preferred to apply a ratio of shrinkage caused by phase change from the liquid phase state to the solid phase for the composition of the molten metal used in continuous casting (linear shrinkage ratio) to the size reduction ratio of the restriction portion to thereby more reliably keep and contact the solidified shell to the mold wall from the stage of starting the formation of the solidified shell.

Further, the restriction portion may be formed with a profile of a straight line, a curve (parabolic curve, arcuate curve or continuous curve), a combination of straight lines and a combination of a straight line and a curve.

While it is required to smoothly withdraw the coagulated and formed cast product in the restriction portion, constrain of the cast product by the restriction portion can be avoided by forming the profile for the restriction portion as a profile slanting inwardly toward the exit, although depending on the position of forming the restriction portion and control for the casting conditions such as withdrawal rate and, further, surface level of molten metal.

In addition, as a vertical cross sectional shape of the restriction portion from the end position to the lower end of the mold, it is preferred to partially or entirely provide a shape corresponding to the amount of solid shrinkage of the cast product, or a single or plurality of continuous tapers.

For maximizing the efficiency of the cooling performance of the mold, contact between the mold and the cast product is made maximum while it may be attained also by the size from the end position of the restriction portion to the exit end of the mold. For this purpose, it is necessary to continue and maintain the contact state with the cast product ensured by the restriction portion and it is recommended to form a taper corresponding to the solid shrinkage of the cast product.

For example, a tapered shape calculated based on the solid shrinkage of the cast product (curve ②), or a one step (line ③) or two step taper (flexed line ④) may be disposed in addition to the profile for the shape shown in FIG. 3.

A concrete embodiment of the present invention is to be explained with reference to a tubular mold shown in FIG. 1 as an example, but it does not restrict the present invention and design modification may be applied optionally within a range not departing the technical concept of the present invention.

The drawing is expressed being emphasized somewhat for better understanding of the present invention, and constitutions of restriction portions of different embodiments are also illustrated on the left and the right of the drawing.

A mold 1 has a cavity 2 opened at upper and lower ends, in which an upper opening 4 in the cavity 2 is formed so as to be gradually enlarged from the meniscus position 3 toward the upper end to facilitate an inserting operation of a dip nozzle or the like upon casting. A restriction portion 6 to be described later shown by points b, c or b, c, d is formed at the meniscus position 3, and a taper 7 corresponding to the solid shrinkage of a solidified shell is formed in contiguous with the restriction portion 6 toward a lower end opening 9.

One embodiment of the restriction portion 6 of the cavity 2 described above is to be explained based on the constitution shown in the right-half of FIG. 1. The mold 1 forms the diverging opening 4 from the meniscus position 3 toward the upper end, in which a range corresponding to the maximum stroke of the mold vibration is formed about the meniscus position 3 as a center in the form of a straight portion (point a→point b), and the start position b of the restriction portion 6 is situated below the meniscus position 3.

The taper progresses from the start position b of the restriction portion 6 at a reduction ratio corresponding to the shrinkage caused by phase change from the liquid phase state to the solid phase inward the mold so as to narrow the cavity and ends at the position for the point c. The surface shown by the point b point c in the restriction portion 6 defines a slope, which is formed considering withdrawal of the cast product and which has an effect of moderating constrain of the solidified shell during movement (accompanied by withdrawal of the cast product).

While it is also possible to form the cavity in parallel with the axial center of the mold from the end position c of the restriction portion 6 to the exit end e of the mold 1, it is desirable to provide a tapered shape 7 toward the exit end e while considering the solid shrinkage of the cast product. Such a shape of the cavity 2 can support the solidified shell coagulated and formed at the meniscus position immediately thereafter and apply the cooling function.

Another constitution of the restriction portion 6 shown in the left-half in FIG. 1 is to be explained. This is different from the first constitution in that the restriction portion 6 is constituted stepwise. That is, the reduction ratio of the cavity 2 is made larger from the starting position b to the intermediate position c of the restriction portion 6, while the reduction ratio is made smaller from the intermediate position c to the end position d, by which the innermost side of the restriction portion 6 protruding into the mold cavity 2 is formed as a smooth curve to provide a guide function for the cast product in the same manner as described above.

Also in this embodiment, a tapered shape 7 corresponding to the solid shrinkage of the solidified shell is provided to a portion between the end position d of the restriction portion and the lower end e of the mold. The tapered shape may be provided with a shape corresponding to the solid shrinkage of the solidified shell, a linear taper, a two step taper or the like.

The behavior of the molten steel in the continuous casting mold during continuous casting of the embodiment according to the present invention is to be explained with reference to the left-half in FIG. 1. Shrinkage caused by phase change from the liquid phase state to the solid phase of the solidified shell of the molten metal charged into the mold and the dimensional change of the cast product by solid shrinkage are shown by fat solid lines.

The molten steel charged into the mold 1 is intensively cooled by the mold near the meniscus position 3 by which the molten steel is solidified to form the solidified shell.

In this step, the formed solidified shell theoretically causes dimensional shrinkage by shrinkage caused by phase change from the liquid phase state to the solid phase, starts shrinkage from the point a and completes shrinkage at point f as the surface layer of the solidified shell.

Actually, the shrinkage caused by phase change from the liquid phase state to the solid phase of the solidified shell traces the process of point a→f shown by a broken line instead of point a→f while undergoing the effect of withdrawal as the casting rate, and completes solidification at the surface layer of the solidified shell at point f.

Subsequently, the surface layer of the solidified shell takes place solid shrinkage along with the cooling effect of the mold as: point f (or f) →g→h→d →e while being in contact with the mold.

As can be seen from the drawing, while the molten steel forms an air gap G at the meniscus portion. In the present invention, the solidified shell can be reliably brought into contact with the inner wall of the mold already from the initial stage of forming the solidified shell corresponding to the dimensional shrinkage of the shrinkage caused by phase change from the liquid phase state to the solid phase of the solidified shell by the restriction portion 6, particularly, the portion bc corresponding to the amount of shrinkage caused by phase change from the liquid phase state to the solid phase of the molten steel and, as a result, formation of the air gap can be prevented. Then, since the formation of the air gap can be prevented, the entire solidified shell of the cast product of the cast product (particularly, the solidified shell at the corners of the cast product) can be kept in a preferred contact state with the inside of the mold even after the end position, that is, point d of the restriction portion 6 and the cast product can be cooled uniformly and efficiently.

The behavior of the continuous casting of molten steel in the existent continuous casting mold is to be explained with reference to the left-half in FIG. 1. In the existent mold, a two step taper (a–i–j portion) 8 corresponding to the solid shrinkage of the solidified shell is disposed. As the taper shape, it is preferred to dispose a shape corresponding to the solid shrinkage of the solidified shell (curve ⑤), but a linear taper (line ⑥) or two step taper (flexed line ⑦) is usually disposed considering the fabricability of the mold upon manufacture as shown in the existent examples in FIG. 3.

In this existent mold 1, since the amount for the shrinkage caused by phase change from the liquid phase state to the solid phase of the solidified shell shown by a fat line corresponding to points a→f is not taken into consideration, an air gap 17 is formed between the mold and the cast product.

The air gap 17 remarkably lowers heat conduction between the mold and the solidified shell. Then, along with progress of continuous casting, the solidified shell takes place creeping by the static pressure of the molten steel acting on the inside of the cast product for the surface (side) portion of the cast product in the lower part of the mold, to cause contact between the cast product and the mold. However, the air gap is left as it is at the corners of the cast product to cause cooling delay at the corners of the cast product.

As a result, the thickness of the solidified shell is not uniform tending to cause internal cracks at the corners of the cast product or break-out of the cast product as described previously.

EXAMPLE

Then, results of experiments for continuous casting are shown by using the continuous casting mold according to the present invention and the continuous casting mold in the existent example.

The continuous casting conditions in this example are shown below.

| | |
|---|---|
| Kind of molten steel: | carbon steel (0.25 mass % C) |
| Casting temperature of molten steel: | 1550° C. |
| Billet size: | 130 mm square |
| Dimensional Shrinkage ratio: | about 0.7% |
| Vibration amplitude of mold: | 10 mm |

The mold of the restriction portion 6 illustrated in the left-half in FIG. 1 was adopted as a mold, and a tubular mold of 800 mm entire length L was formed with a meniscus position 3 being defined at 80 mm from the upper end of the mold, the starting position b in the restriction portion 6 being defined at 13 mm below the meniscus position 3, and the shape for the portion a→b of the mold was made straight. Assuming the dimensional shrinkage ratio as about 0.7% and the size of the cavity was defined such that the cavity dimension D1 at the starting position b of the restriction portion 6 was 135.3 mm, the cavity dimension D2 at the end position d was 134.4 mm, the dimension D3 at the lower end position e of the cavity was 134.0 mm, and the distance X in the mold withdrawing direction from the meniscus position 3 to the end position d of the restriction portion 6 was 33 mm. Further, the profile from the starting position b to the intermediate portion c of the restriction portion 6 was made as a straight line inclined slightly inwardly, the cavity dimension at the position was 134.5 mm and the distance from the meniscus position 3 was 20 mm. A portion from the intermediate position c to the end point position d was formed as a smooth curve and, further, a linear taper was 7 was provided from the end position d to the cavity lower end position e.

In this embodiment, continuous casting was conducted by setting the casting rate at 3.0 m/min corresponding to the highest speed in the country for the kind of this size under the continuous casting conditions described above, the casting rate was gradually increased as the operation was stabilized, and then continuous casting was conducted at a casting rate of 4.5 m/min which is 1.5 times as high as the usual rate. The operation was continued in the stable state and continuous casting could be completed to the last with no formation of break-out in the cast product.

Figure 6:
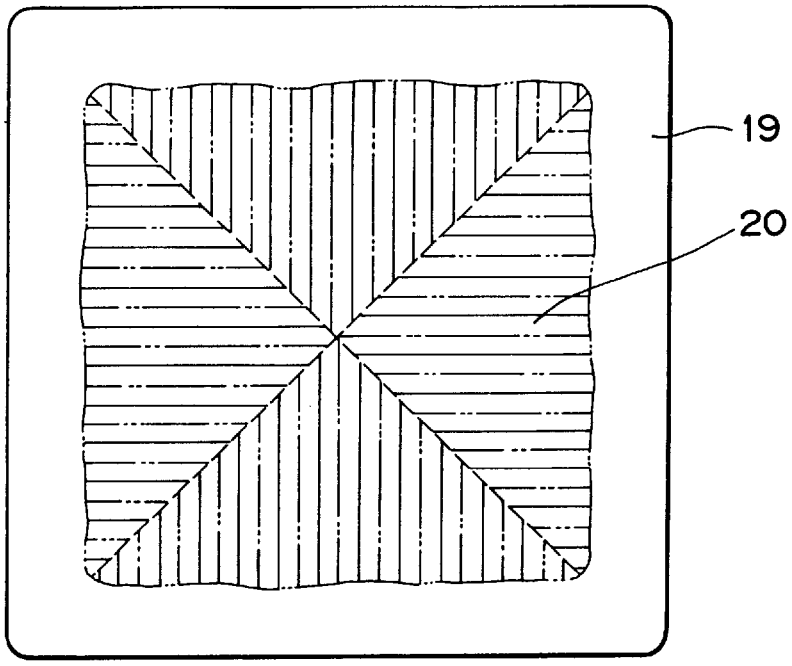
FIG. 6 is a schematic view showing a cross sectional structure of a billet in an embodiment according to the present invention.

The cross sectional structure of a billet obtained by this example was exactly reproduced from a sulfur print and the result is shown in FIG. 6.

As shown in FIG. 6, the cross sectional structure of the billet manufactured by using the continuous casting mold according to the present invention had a chilled layer 19 of uniform and large thickness, no internal cracks were observed at the corners of the billet and the cross section of the billet was in a normal shape although the casting was conducted at a high speed 1.5 times as high as the existent casting rate.

For comparison with the present invention, continuous casting was conducted by using an existent type tubular mold with mold length L of 800 mm, cavity dimension D1 at the meniscus position 3 of 134,4 mm and cavity dimension D3 at the mold lower end of 134.0 mm, in which one step linear taper 8 was provided from the meniscus position 3 to the mold lower end.

Then, also in the comparative example, billets were manufactured by conducting continuous casting at a casting rate under the continuous casting conditions described above, namely, at a casting rate of 3.0 m/min.

Figure 7:
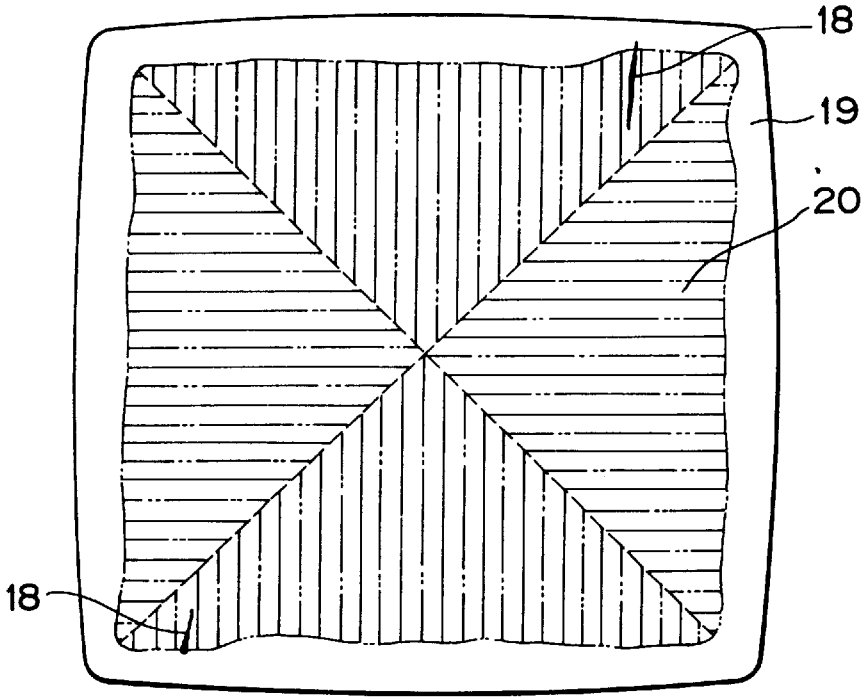
FIG. 7 is a schematic view showing a cross sectional structure of a billet of an existent example.

As shown in FIG. 7, in this comparative example, the thickness of a chilled layer 19 in the cross sectional structure of the billet is thin and, particularly, the thickness of the chilled layer 19 was extremely thin as from 2 to 3 mm at the corners, in which internal cracks 18 were observed. The internal cracks 18 are formed not only in the chilled layer 19 but also developed as far as the dendritic crystals 20 inside of the cast product. Accordingly, the casting rate could not be increased in view of the worry of break-out.

Then, bulging deformation for the surface caused by the static pressure of the molten steel was recognized in the cross section of the billet.

As has been apparent from the foregoings, when the continuous casting mold of the present invention is used, the chilled layer is uniformly thick and no internal cracks are formed at the corners of the billets, as well as billets of normal cross sectional shape can be obtained, compared with the case of using the existent continuous casting mold, even when the casting rate is increased by 1.5 times than usual.

The mold for use in continuous metal casting according to the present invention is not restricted to the embodiments or examples thereof but can be used, for example, in continuous molding of cast products such as slabs and blooms not only in continuous casting of billets. Then, also the shape of the billet is not restricted to a normal square cross section as in this example, but the invention is applicable also to a rectangular, hexagonal, octagonal or circular billet.

Furthermore, the present invention is applicable not only to molten steel but also to molten metal accompanied by shrinkage upon phase change from liquid to solid as the molten metal to be cast continuously (for example, molten metal of aluminum alloy and copper alloy).

Although the invention has been described by way of example and with reference to possible embodiments thereof it is to be understood that modifications or improvements may be made thereto without departing from the scope of the invention as defined in the appended claims.

The entire disclosure of Japanese Patent Application No. 10-217576 filed on Jul. 31, 1998 including specification, drawings and summary are incorporated herein by reference in its entirety.

We claim:

1. A mold for continuous metal casting comprising:

a cavity defined by a vertical axis and a wall having a vertical cross section of an inner surface symmetrical to the axis and open at a top end and a bottom end, the vertical cross section of the inner surface of the wall having at least a first and a second tapered portions, the first tapered portion located above the second tapered portion, being steeper than the second tapered portion, wherein a molten metal is cast at a meniscus position situated within the first tapered portion, and the amount of solidification shrinkage caused by phase change from liquid phase to solid phase of the cast metal is absorbed by a restriction portion situated between a molded product and a section of the inner surface of the wall, and the section of the inner surface of the wall situated within the second tapered portion and below the meniscus position by at least a vibration amplitude of the mold.

2. A mold as defined in claim 1, wherein the restriction potion is disposed up to 100 mm from the meniscus position along the axis.

3. A mold as defined in claim 2, wherein a horizontal cross-section of the cavity at the top end of the restriction portion is the same as a horizontal cross-section of the cavity at the meniscus position, and a horizontal cross-section of the cavity at a bottom end of the restriction portion is less than the horizontal cross-section of the cavity at the meniscus position by 0.2% to 1.5%.

4. A mold as defined in claim 3, wherein a second restriction portion situated between the molded product and a second section of the inner surface of the wall for absorbing the amount of solid shrinkage caused by temperature reduction since the end of solidification until the molded product is removed from the mold, the second section of the inner surface of the wall begins from the bottom end of the restriction portion to the bottom end of the wall.

5. A mold as defined in claim 4, wherein the second restriction portion is formed with a straight line, a curve, or a combination of a straight line and a curve within a third tapered portion or a plurality of continuous tapered portions on the vertical cross section.

6. A mold as defined in claim 2, wherein the restriction portion is formed with a straight line, a curve, or a combination of a straight line and a curve within the second tapered portion on the vertical cross section.

7. A mold as defined in claim 2, wherein a second restriction portion situated between the molded product and a second section of the inner surface of the wall for absorbing the amount of solid shrinkage caused by temperature reduction since the end of solidification until the molded product is removed from the mold, the second section of the inner surface of the wall begins from the bottom end of the restriction portion to the bottom end of the wall.

8. A mold as defined in claim 7, wherein the second restriction portion is formed with a straight line, a curve, or a combination of a straight line and a curve within a third tapered portion or a plurality of continuous tapered portions on the vertical cross section.

9. A mold as defined in claim 1, wherein a horizontal cross-section of the cavity at the top end of the restriction portion is the same as a horizontal cross-section of the cavity at the meniscus position, and a horizontal cross-section of the cavity at a bottom end of the restriction portion is less than the horizontal cross-section of the cavity at the meniscus position by 0.2% to 1.5%.

10. A mold as defined in claim 9, wherein the restriction portion is formed with a straight line, a curve, or a combination of a straight line and a curve within the second tapered portion on the vertical cross section.

11. A mold as defined in claim 9, wherein a second restriction portion situated between the molded product and a second section of the inner surface of the wall for absorbing the amount of solid shrinkage caused by temperature reduction since the end of solidification until the molded product is removed from the mold, the second section of the inner surface of the wall begins from the bottom end of the restriction portion to the bottom end of the wall.

12. A mold as defined in claim 11, wherein the second restriction portion is formed with a straight line, a curve, or a combination of a straight line and a curve within a third tapered portion or a plurality of continuous tapered portions on the vertical cross section.

13. A mold as defined in claim 1, wherein the restriction portion is formed with a straight line, a curve, or a combination of a straight line and a curve within the second tapered portion on the vertical cross section.

14. A mold as defined in claim 1, wherein a second restriction portion situated between the molded product and a second section of the inner surface of the wall for absorbing the amount of solid shrinkage caused by temperature reduction since the end of solidification until the molded product is removed from the mold, the second section of the inner surface of the wall begins from the bottom end of the restriction portion to the bottom end of the wall.

15. A mold as defined in claim 14, wherein the second restriction portion is formed with a straight line, a curve, or a combination of a straight line and a curve within a third tapered portion or a plurality of continuous tapered portions on the vertical cross section.

16. A mold for continuous metal casting comprising:

a cavity defined by a vertical axis and a wall having a vertical cross section of an inner surface symmetrical to the axis and open at a top end and a bottom end, the vertical cross section of the inner surface of the wall having at least a first and a second tapered portions, the first tapered portion located above the second tapered portion, being steeper than the second tapered portion, wherein a molten metal is cast at a meniscus position situated within the first tapered portion, and the amount of solidification shrinkage caused by phase change from liquid phase to solid phase of the cast metal is absorbed by a restriction portion situated between a molded product and a section of the inner surface of the wall, and the section of the inner surface of the wall situated within the second tapered portion and below the meniscus position by at least a vibration amplitude of the mold so as to form a solidified shell reliably formed and kept in contact with the inner surface of the mold thereby that no air gap is formed between the mold and a molded product outside of the restriction portion due to the shrinkage or a vibration of the mold.

17. A mold as defined in claim 16, wherein a bottom end of the restriction portion is defined by a rate of casting the metal into the mold which determines when the solidified shell is reliably formed and kept in contact with the inner surface of the mold.

* * * * *